US009676450B1

(12) United States Patent
Brignolio

(10) Patent No.: US 9,676,450 B1
(45) Date of Patent: Jun. 13, 2017

(54) PONTOON STRUCTURE FOR SUPPORTING A BOAT BODY

(71) Applicant: James C. Brignolio, Manteca, CA (US)

(72) Inventor: James C. Brignolio, Manteca, CA (US)

( * ) Notice: Subject to any disclaimer, the term of this patent is extended or adjusted under 35 U.S.C. 154(b) by 0 days.

(21) Appl. No.: 15/133,933

(22) Filed: Apr. 20, 2016

(51) Int. Cl.
*B63B 1/34* (2006.01)
*B63B 1/20* (2006.01)
*B63B 35/38* (2006.01)

(52) U.S. Cl.
CPC ..... *B63B 1/34* (2013.01); *B63B 1/20* (2013.01); *B63B 35/38* (2013.01); *B63B 2001/208* (2013.01)

(58) Field of Classification Search
CPC .... B63B 1/00; B63B 1/20; B63B 1/12; B63B 1/121; B63B 1/125; B63B 1/10; B63B 1/16; B63B 1/18
USPC ..... 114/271, 288, 292, 61.2
See application file for complete search history.

(56) References Cited

U.S. PATENT DOCUMENTS

| | | | | |
|---|---|---|---|---|
| 5,184,561 | A | 2/1993 | Nickell, Jr. | |
| 5,570,650 | A | 11/1996 | Harley | |
| 6,016,762 | A | 1/2000 | Price | |
| 6,085,677 | A * | 7/2000 | Bell | B63B 1/20 114/61.1 |
| 6,598,552 | B1 | 7/2003 | Rouse | |
| 7,458,327 | B1 | 12/2008 | Dunkerson | |
| 7,798,088 | B2 | 9/2010 | Hoover et al. | |
| 7,827,926 | B2 | 11/2010 | Payne | |
| 7,950,340 | B1 * | 5/2011 | Curtis | B63B 1/20 114/61.1 |
| 2009/0031939 | A1 | 2/2009 | Fishburn | |
| 2009/0293790 | A1 * | 12/2009 | Bogard | B63B 1/20 114/61.2 |

* cited by examiner

*Primary Examiner* — Lars A Olson
(74) *Attorney, Agent, or Firm* — Thomas R. Lampe

(57) ABSTRACT

Pontoon structure for a boat includes an elongated pontoon with a bottom forming a water entrapment channel between a front end portion and a rear end portion of the pontoon, the bottom configuration causing the pontoon and the supported boat body to quickly rise above the water surface and plane.

10 Claims, 6 Drawing Sheets

PONTOON STRUCTURE FOR SUPPORTING A BOAT BODY

TECHNICAL FIELD

This invention relates to watercraft, more particularly to pontoon structure employable in pontoon boats.

BACKGROUND OF THE INVENTION

Pontoon boats are a popular form of watercraft for recreational use. A number of arrangements have been developed and utilized in association with pontoon boats to enable them to go faster than boats employing pontoons having round cross sections, which stay submerged to a considerable degree during use, essentially "plowing" through the water as the boat is propelled forward by an associated motor or motors.

One such development has been the adoption and use of lifting strakes in association with round pontoons.

Another approach has been to provide pontoons having hull-like configurations aimed at lifting and planing across the water.

The following patent documents are considered representative of the current state of the prior art relating to hull-like pontoon constructions: U.S. Pat. No. 6,085,677, issued Jul. 11, 2000, U.S. Pat. No. 7,827,926, issued Nov. 9, 2010, U.S. Pat. No. 7,458,327, issued Dec. 2, 2008, U.S. Pat. No. 7,798,088, issued Sep. 21, 2010, U.S. Pat. No. 6,016,762, issued Jan. 25, 2000, U.S. Pat. No. 6,598,552, issued Jul. 29, 2003, U.S. Pat. No. 5,570,650, issued Nov. 5, 1996, U.S. Pat. No. 5,184,561, issued Feb. 9, 1993 and U.S. Patent Application Pub. No. US 2009/0031939, published Feb. 5, 2009.

DISCLOSURE OF INVENTION

The present invention provides a number of advantages over the prior art approaches, including incorporation of water entrapment structure in the pontoon which when under power will cause the boat to rise upon the surface of the water and plane rather than plowing through the water as a round pontoon design does. This feature substantially reduces drag on the pontoon and increases speed of the boat. It will also substantially decrease fuel use and decrease the amount of time it takes the boat to plane.

Another feature of the present invention is incorporation of flotation structure which will increase buoyancy of a pontoon which will have the effect of not only causing the hull to plane faster, but it also compensates for the weight of an outboard motor and fuel. That flotation feature will allow the boat at rest to float level in the water.

Furthermore, the even weight distribution created by the additional flotation at the rear of the boat will allow the boat to cruise at a more level plane under power, rather than the rear running lower in the water as is the case with round pontoons and other known pontoon configurations which result in more drag, less speed and more fuel use.

The pontoon structure of the present invention for supporting a boat body on water includes at least one elongated pontoon having a pontoon front end portion, a pontoon rear end portion, a pontoon top, a pontoon bottom having spaced bottom edges and spaced flat pontoon side walls extending between the pontoon top and the pontoon bottom.

The pontoon bottom includes a pair of elongated bottom segments angularly disposed relative to the pontoon side walls attached to and extending inwardly and upwardly from the bottom edges. The elongated bottom segments have upward distal edges and an elongated bottom central segment extends between and is affixed to the upper distal edges of the elongated bottom segments.

The inwardly and upwardly extending elongated bottom segments and the elongated bottom central segment form a water entrapment channel continuously extending between the pontoon front end portion and the pontoon rear end portion. Water entrapped in the water entrapment channel passes unimpeded therethrough from the pontoon front end portion to the pontoon rear end portion when the boat is under power. The configuration of the bottom causes the boat body to rise above the surface of the water and plane, thereby reducing drag and increasing boat speed.

Another feature of the present invention includes a flotation compartment structure attached to and projecting outwardly from the pontoon rear end portion to provide additional buoyancy at the pontoon rear end portion.

Other features, advantages and objects of the present invention will become apparent with reference to the following description and accompanying drawings.

BEST MODE FOR CARRYING OUT THE INVENTION

Figure 1:
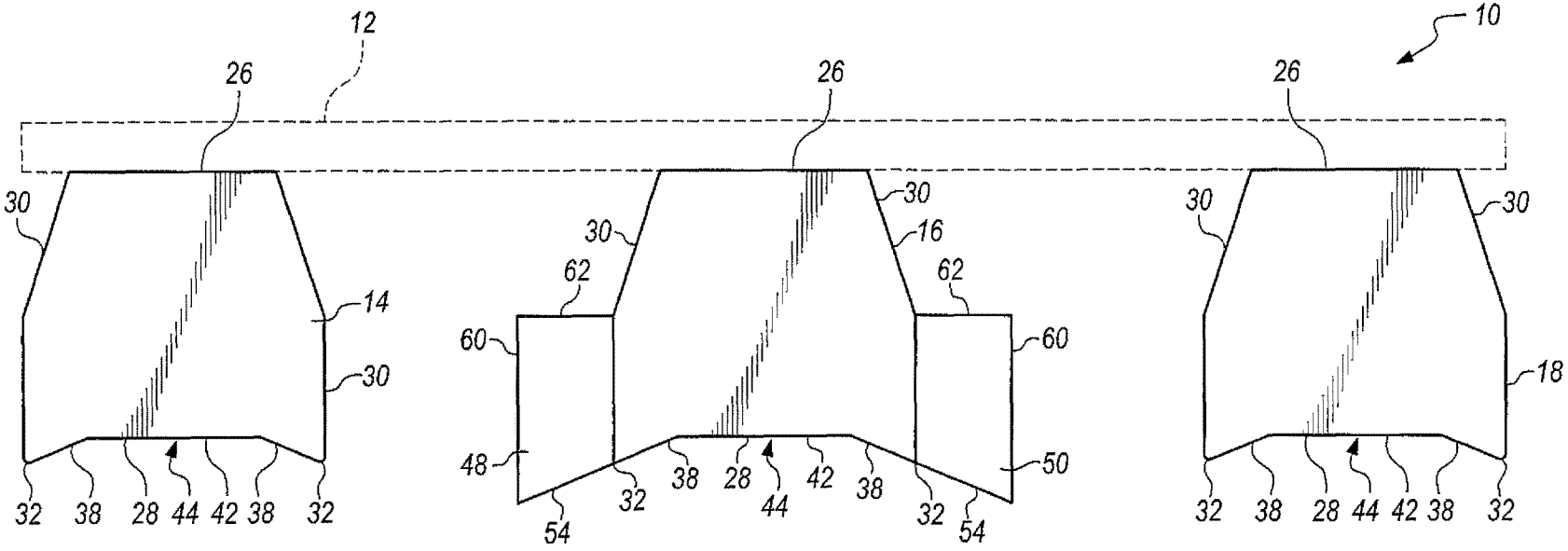
FIG. 1 is a rear elevational view showing three pontoons constructed in accordance with the teachings of the present invention employed to support a boat body, the latter represented by dash lines.
Figure 2:
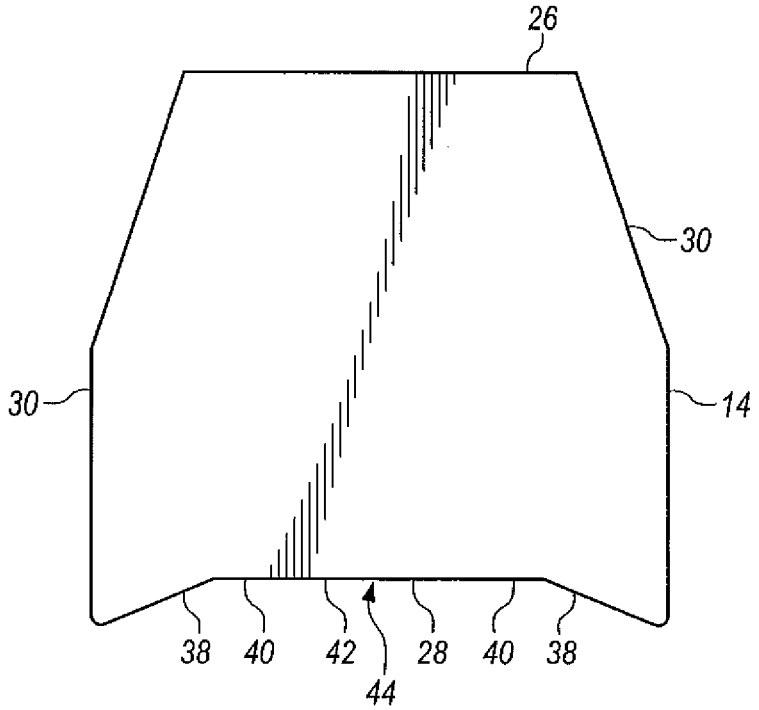
FIG. 2 is an enlarged, rear elevation view of one of the two outer pontoons employed.
Figure 3:
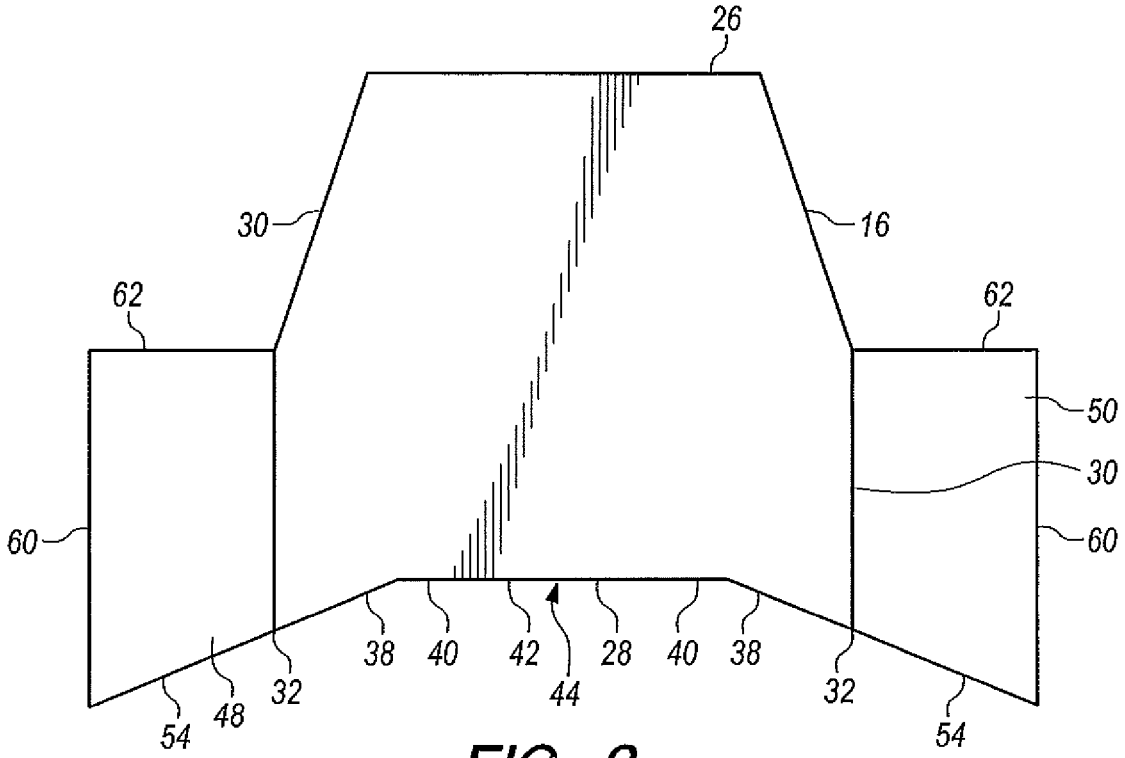
FIG. 3 is an enlarged, rear elevation view of the center pontoon.
Figure 4:
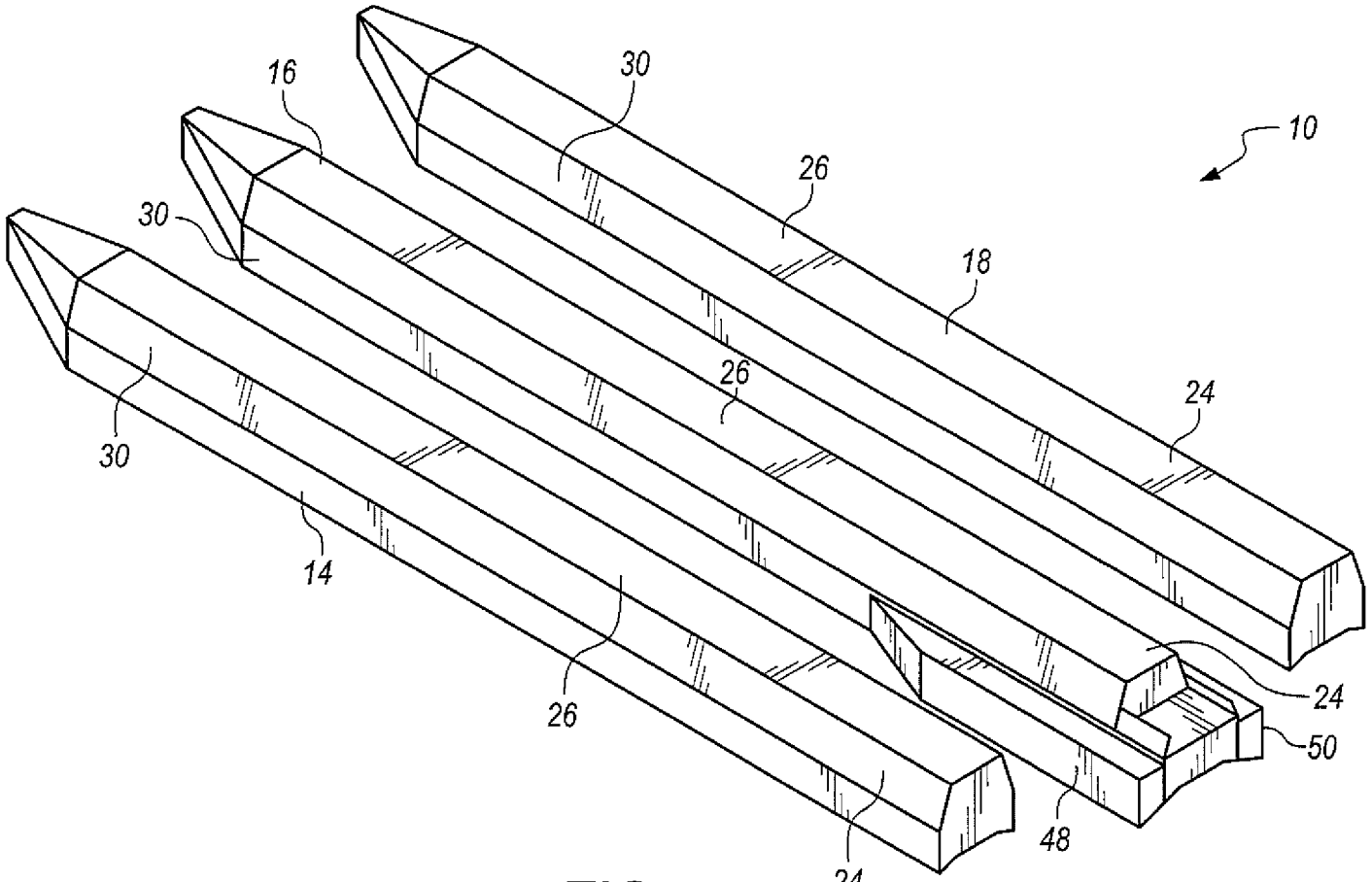
FIG. 4 is a top, rear perspective view of the three pontoons.
Figure 5:
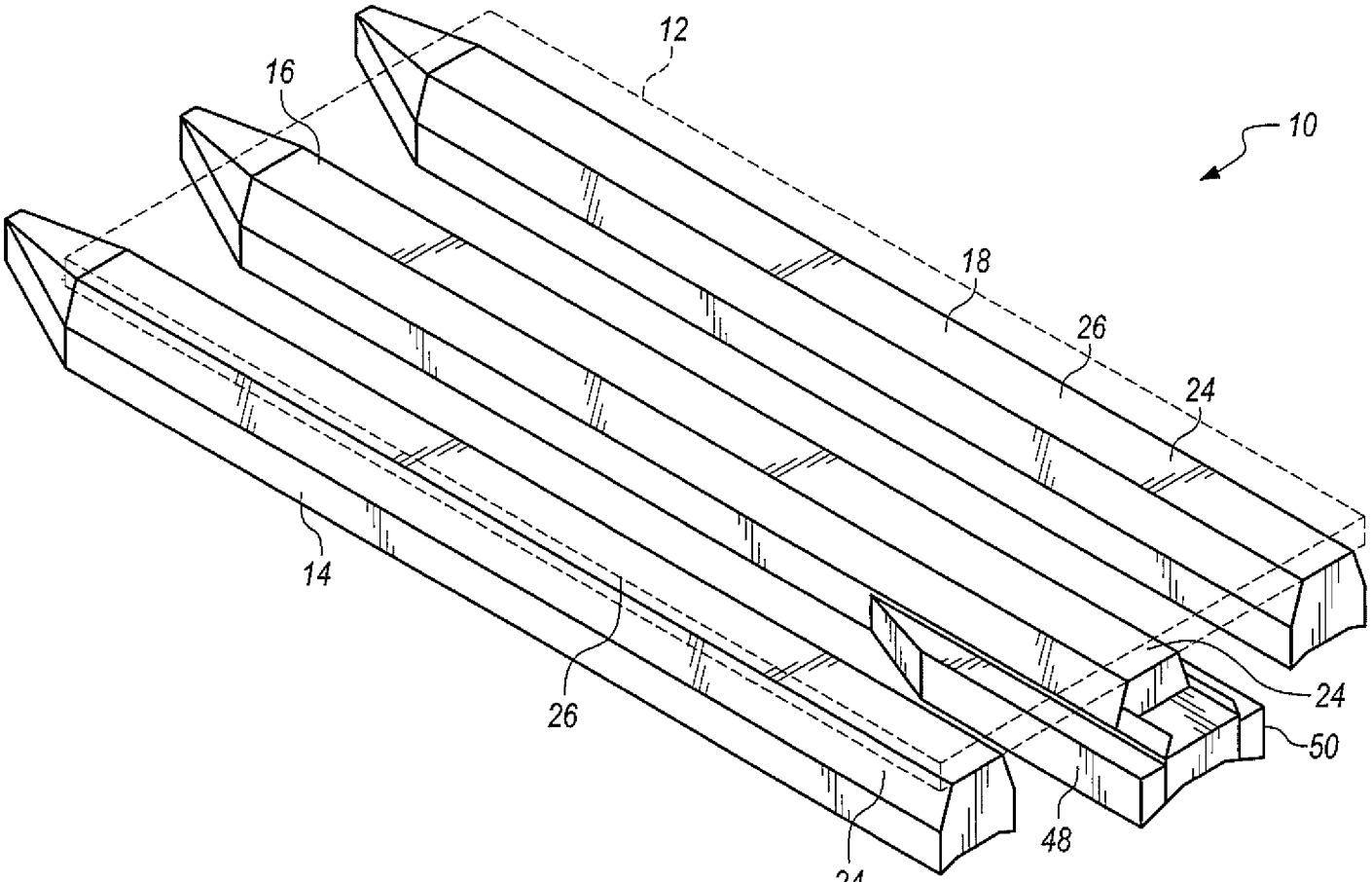
FIG. 5 is a top, rear perspective view illustrating positioning of the three pontoons relative to a boat body, the latter represented by dash lines.
Figure 6:
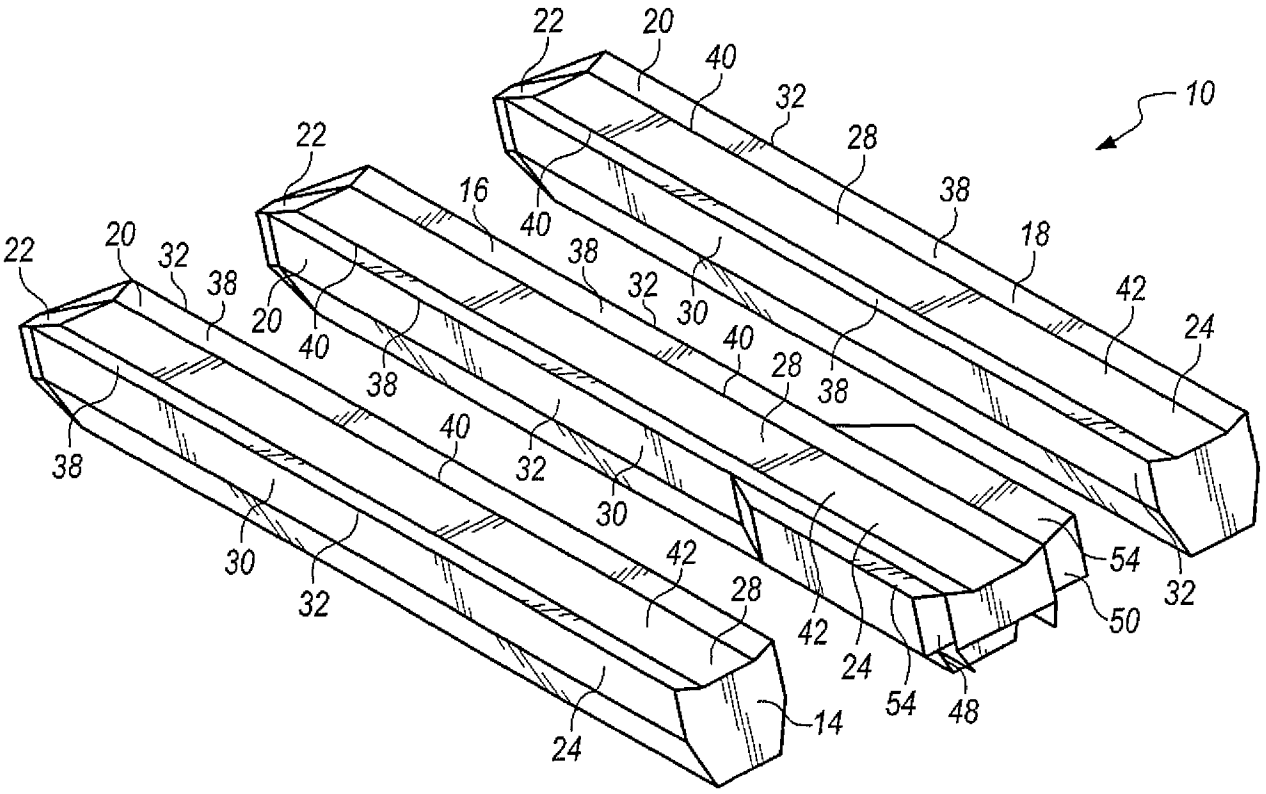
FIG. 6 is a bottom, rear perspective view of the three pontoons.
Figure 7:
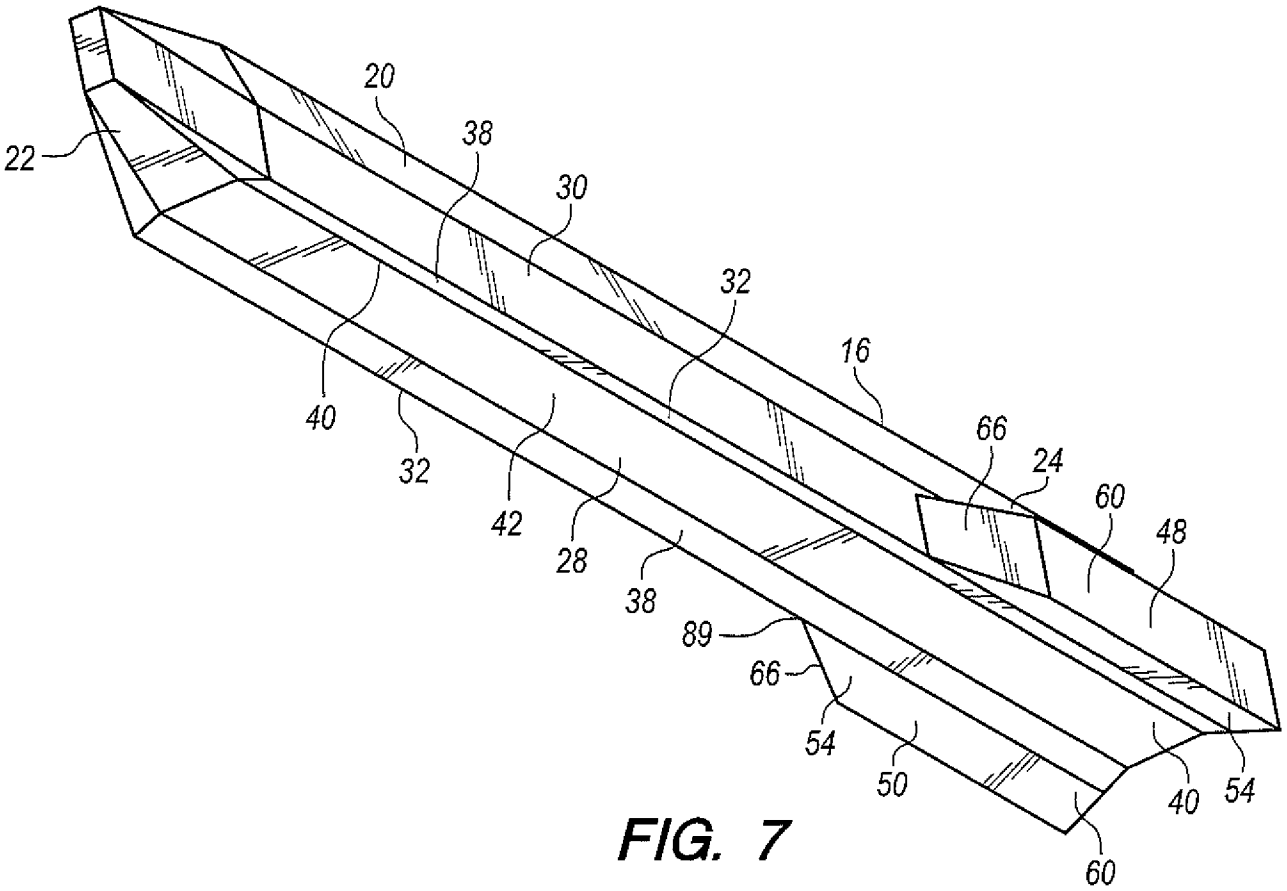
FIG. 7 is a bottom, front perspective view of the center pontoon.

Referring now to the drawings, a pontoon structure 10 constructed in accordance with the teachings of the present invention is illustrated. The pontoon structure is for supporting the boat body on water. In FIGS. 1 and 5 dash lines are employed to illustrate a boat body in the form of a platform 12. In the arrangement illustrated, the pontoon structure includes three pontoons 14, 16 and 18 supporting the boat body and spaced from one another. The elongated pontoons each have a pontoon front end portion 20 having a forward end 22 in the general form of a truncated, flat sided cone. Each pontoon also has a pontoon rear end portion 24, a pontoon top 26, a pontoon bottom 28 and spaced pontoon side walls 30 extending between the pontoon top and the pontoon bottom, the foregoing structural elements defining a pontoon interior.

The pontoon bottom has spaced bottom edges 32. The pontoon bottom 28 includes a pair of elongated bottom segments 38 which are angularly disposed relative to the pontoon side walls and which are attached to the side walls and extend inwardly and upwardly from the bottom edges 32.

The elongated bottom segments 38 have upper distal edges 40. The pontoon bottom also includes an elongated bottom central segment 42 extending between and affixed to the upper distal edges 42 of the elongated bottom segments 38.

The inwardly and upwardly extending elongated bottom segments 38 and the elongated bottom central segment 42 form a water entrapment channel 44 continuously extending between the pontoon front end portion 20 and the pontoon rear end portion 24. Water entrapped in the water entrapment channel passes unimpeded therethrough from the pontoon front end portion to the pontoon rear end portion when the boat is under power, the configuration of the bottom causing the body to rise above the surface of the water and plane, thereby reducing drag and increasing boat speed.

The structure of centrally disposed pontoon 16 differs from the structures of pontoons 14 and 18 by virtue of the fact that flotation compartment structure is attached to and projects outwardly from the pontoon rear end portion of centrally disposed pontoon 16 to provide additional buoyancy at the pontoon rear end portion.

The flotation compartment structure is in the form of a pair of watertight compartments 48, 50. Watertight compartment 50 is attached to and extends laterally outwardly from one side wall of the pontoon rear end portion and watertight compartment 50 is attached to and extends laterally outwardly from the other of the pontoon side walls at the pontoon rear end portion.

The watertight compartments are of like construction and are diametrically disposed on and project horizontally outwardly from the pontoon rear end portion.

The watertight compartments 48, 50 have downwardly and outwardly extending bottom compartment walls 54 in alignment with and constituting extensions of the elongated bottom segments of the elongated pontoon and are cooperable therewith to enlarge the water entrapment channel at the location of the pontoon rear end portion.

Each watertight compartment includes a compartment outer side wall 60 extending upwardly from the bottom compartment wall 54 and extending rearwardly a predetermined distance along the pontoon side wall substantially less than the total length of the pontoon.

Each watertight compartment also includes a compartment top wall 62 disposed between the compartment outer side wall 60 and the pontoon.

Each watertight compartment additionally includes a compartment front wall 66 attached to the compartment bottom wall 54, the compartment side wall 60, the compartment top wall 62 and the pontoon side wall 30. The end of the compartment front wall 66 is angularly disposed relative to the compartment side wall and the pontoon side wall and has a leading end 68 located at the pontoon side wall, reducing drag.

The extra buoyancy on each side of the center pontoon will not only cause the pontoon structure and boat to plane faster it compensates for the weight of the outboard motor or motors and fuel.

The even weight distribution created by the additional flotation at the rear of the boat will allow the boat to cruise at a more level plane under power rather than the rear running lower in the water as would be the situation with round and other types of pontoons.

The invention claimed is:

1. A pontoon structure for supporting a boat body on water, said pontoon structure including at least one elongated pontoon having a pontoon front end portion, a pontoon rear end portion, a pontoon top, a pontoon bottom having spaced bottom edges, and spaced pontoon side walls extending between said pontoon top and said pontoon bottom, said pontoon bottom including a pair of elongated bottom segments angularly disposed relative to said pontoon side walls attached to and extending inwardly and upwardly from the bottom edges, said elongated bottom segments having upper distal edges, and an elongated bottom central segment extending between and affixed to the upper distal edges of said elongated bottom segments, said inwardly and upwardly extending elongated bottom segments and said elongated bottom central segment forming a water entrapment channel continuously extending between said pontoon front end portion and said pontoon rear end portion, water entrapped in said water entrapment channel passing unimpeded therethrough from said pontoon front end portion to said pontoon rear end portion when the boat is under power, with the configuration of said bottom causing the boat body to rise above the surface of the water and plane, thereby reducing drag and increasing boat speed, said pontoon structure including a flotation compartment structure attached to and projecting outwardly from the pontoon rear end portion to provide additional buoyancy at the pontoon rear end portion, said flotation compartment structure comprising a pair of watertight compartments, one of said watertight compartments attached to and extending laterally outwardly from one pontoon side wall of the pontoon rear end portion and the other of said watertight compartments attached to and extending laterally outwardly from the other of said pontoon side walls at the pontoon rear end portion, said watertight compartments being of like construction and diametrically disposed on and projecting horizontally outwardly from the pontoon rear end portion, and said watertight compartments having downwardly and outwardly extending bottom compartment walls in alignment with and constituting extensions of said elongated bottom segments of the elongated pontoon and cooperable therewith to enlarge the water entrapment channel at the location of said pontoon rear end portion.

2. The pontoon structure according to claim 1 wherein said at least one elongated pontoon comprises one of a plurality of pontoons supporting the boat body and spaced from one another, each of said plurality of elongated pontoons having pontoon bottoms including a pair of elongated segments angularly disposed relative to said pontoon side walls attached to and extending inwardly and upwardly from the bottom edges of said pontoon side walls, said elongated bottom segments having upper distal edges, and an elongated bottom central segment extending between and affixed to the upper distal edges of said elongated bottom segments, said inwardly and upwardly extending elongated bottom segments and said elongated bottom central segment forming a water entrapment channel continuously extending between said pontoon front end portion and said pontoon rear end portion, water entrapped in said water entrapment channel of each pontoon passing unimpeded therethrough from said pontoon front end portion to said pontoon rear end portion when the boat is under power, with the configuration of said bottom causing the boat body to rise above the surface of the water and plane, thereby reducing drag and increasing boat speed.

3. The pontoon structure according to claim 1 wherein each watertight compartment includes a compartment outer side wall extending upwardly from the bottom compartment wall and extending rearwardly a predetermined distance along a pontoon side wall substantially less than the total length of said pontoon.

4. The pontoon structure according to claim 3 wherein each watertight compartment includes a compartment top wall disposed between said compartment outer side wall and said pontoon.

5. The pontoon structure according to claim 4 wherein each watertight compartment additionally includes a compartment front wall attached to said compartment bottom wall, said compartment side wall, said compartment top wall and said pontoon side wall, said compartment front wall angularly disposed relative to said compartment side wall and said pontoon side wall and having a leading end located at said pontoon side wall.

6. A pontoon structure for supporting a boat on water, said pontoon structure including a plurality of pontoons supporting the boat body and spaced from one another, at least one of said plurality of elongated pontoons having pontoon bottoms including a pair of elongated segments angularly disposed relative to said pontoon side walls attached to and extending inwardly and upwardly from the bottom edges, said elongated bottom segments having upper distal edges, and an elongated bottom central segment extending between and affixed to the upper distal edges of said elongated bottom segments, said inwardly and upwardly extending elongated bottom segments and said elongated bottom central segment forming a water entrapment channel continuously extending between said pontoon front end portion and said pontoon rear end portion, water entrapped in said water entrapment channel of each pontoon passing unimpeded therethrough from said pontoon front end portion to said pontoon rear end portion when the boat is under power, with the configuration of said bottom causing the boat body to rise above the surface of the water and plane, thereby reducing drag and increasing boat speed, said at least one elongated pontoon including a flotation compartment structure attached to and projecting outwardly from the pontoon rear end portion to provide additional buoyancy at the pontoon rear end portion, said flotation compartment structure comprising a pair of watertight compartments, one of said watertight compartments attached to and extending laterally outwardly from one pontoon side wall of the pontoon rear end portion and the other of said watertight compartments attached to and extending laterally outwardly from the other of said pontoon side walls at the pontoon rear end portion, said watertight compartments being of like construction and diametrically disposed on and projecting horizontally outwardly from the pontoon rear end portion, and said watertight compartments having downwardly and outwardly extending bottom compartment walls in alignment with and constituting extensions of said elongated bottom segments of the elongated pontoon and cooperable therewith to enlarge the water entrapment channel at the location of said pontoon rear end portion.

7. The pontoon according to claim 6 wherein each watertight compartment includes a compartment outer side wall extending upwardly from the bottom compartment wall and extending rearwardly a predetermined distance along a pontoon side wall substantially less than the total length of said pontoon.

8. The pontoon structure according to claim 7 wherein each watertight compartment includes a compartment top wall disposed between said compartment outer side wall and said pontoon.

9. The pontoon structure according to claim 8 wherein each watertight compartment additionally includes a compartment front wall attached to said compartment bottom wall, said compartment side wall, said compartment top wall and said pontoon side wall, said compartment front wall angularly disposed relative to said compartment side wall and said pontoon side wall and having a leading end located at said pontoon side wall.

10. The pontoon structure according to claim 6 wherein said at least one elongated pontoon is one of three elongated pontoons and is positioned midway between the other two elongated pontoons.

* * * * *